US006272229B1

(12) United States Patent
Baekgaard

(10) Patent No.: US 6,272,229 B1
(45) Date of Patent: Aug. 7, 2001

(54) HEARING AID WITH ADAPTIVE MATCHING OF MICROPHONES

(75) Inventor: Lars Baekgaard, Farum (DK)

(73) Assignee: Topholm & Westermann APS, Vaerloese (DK)

( * ) Notice: Subject to any disclaimer, the term of this patent is extended or adjusted under 35 U.S.C. 154(b) by 0 days.

(21) Appl. No.: 09/445,348

(22) PCT Filed: Aug. 3, 1999

(86) PCT No.: PCT/EP99/05621

§ 371 Date: Dec. 8, 1999

§ 102(e) Date: Dec. 8, 1999

(87) PCT Pub. No.: WO01/10169

PCT Pub. Date: Feb. 8, 2001

(51) Int. Cl.[7] ..... H04C 25/00
(52) U.S. Cl. ..... 381/313; 381/312; 381/92
(58) Field of Search ..... 381/312, 313, 381/316, 317, 318, 320, 321, FOR 127, FOR 128, 92, 94.9

(56) References Cited

U.S. PATENT DOCUMENTS 5,483,599 * 1/1996 Zagorski ..... 381/313
5,515,445 5/1996 Baumhauer, Jr. et al. .
5,524,056 * 6/1996 Brander ..... 381/312
5,627,799 * 5/1997 Hoshuyama ..... 381/92
5,757,933 * 5/1998 Preves et al. ..... 381/313
5,917,921 * 6/1999 Sasaki et al. ..... 381/92
5,978,490 * 11/1999 Choi et al. ..... 381/92
6,002,776 12/1999 Bhadkamkar et al. .
6,101,258 * 8/2000 Killion et al. ..... 381/92

* cited by examiner

*Primary Examiner*—Curtis Kuntz
*Assistant Examiner*—Suhan Ni
(74) *Attorney, Agent, or Firm*—Sughrue, Mion, Zinn, Macpeak & Seas, PLLC

(57) ABSTRACT

Hearing aid with a controllable directional characteristic having at least two spaced apart microphones (Mic 1, Mic 2) in at least two microphone channels, at least one signal processing unit, at least one output transducer and a directional controlling system, with means for adaptively matching the characteristics of at least two microphones. This novel hearing aid comprises an adaptive phase matching circuit (1), inserted into said at least two microphone channels, the adaptive phase matching circuit, (1) having its outputs connected to an acoustical delay compensation means (2), followed by a parameter control circuit (3), the output of which is applied to a controllable filter means (4) inserted into at least one of said at least two microphone channels inside said adaptive phase matching circuit. Preferably filter means (5, 6) are provided in front of said acoustical delay compensation means (2), which could be used to eliminate DC components.

14 Claims, 5 Drawing Sheets

HEARING AID WITH ADAPTIVE MATCHING OF MICROPHONES

The invention relates to a hearing aid with a controllable directional characteristic, having at least two spaced apart microphones in at least two microphone channels, at least one signal processing unit, at least one output transducer and a directional controlling system, with means of adaptively matching the characteristics of at least two microphones.

BACKGROUND OF THE INVENTION

In hearing aid systems of this type using at least two spaced apart microphones, it is known that, in the technique for controlling the directionality and beam forming, using multiple microphones, usually two microphones, the realization depends on the microphones being matched as closely as possible with respect to their time an phase relationship as well as their sensitivity, because beam forming techniques make use of the time/phase difference between spaced apart microphones with respect to the direction of the sound received from a sound source.

The difference in the arrival time of signals at the microphone determines at which angles, the zeros in the directional characteristic will be generated.

Any disturbance in this difference in arrival time will disturb the position of the zeros in space, and the directional behaviour will, in this case, never become optimal.

Differences in the sensitivity between hearing aid microphones of the same type could be as large as 6 dB, which would result in a directional behaviour, that—for practical use—is not even there.

The difference in phase could be as large as 10° at low frequencies, which is due to production tolerances in connection with the lower cut-off frequency in the microphones.

In hearing aids with preferably two microphones they will be normally placed apart by a distance of 1 cm. This corresponds to an acoustical delay between the microphones of about 30 μs. Disturbances in the arrival times could of course be very severe, because they could in fact be larger than the actual acoustical delay between the two microphones.

A way to overcome this problem has until now been to use microphones, which were matched in their sensitivity and phase by the supplier.

However, there are some drawbacks in this method:

1. Microphones can not be matched better in their sensitivity by the supplier than to about 0.5 dB. However, o,5 dB is enough to degrade the directional behaviour heavily at 200–300 Hz.
2. Microphones can not be matched better in phase than about 2°, because of the needed precision in the equipment used to measure the microphones. 2° corresponds at 200 Hz to about 28 μs, which in many cases is enough to move the directional characteristic, so that directions which were actually intended to be damped, remain almost undamped, and therefore will be transmitted with the same strength as the signal coming from the desired direction.
3. The two electrical inputs in the hearing aid need to be matched as well, for the beam forming to work well. This implies a special selection of the components to be used, because the tolerances of e.g. capacitors are not sufficiently narrow.
4. In case of one microphone or other components becoming defective, it will be necessary to exchange all microphones (or other components) as matched sets which will make the necessary service operation much more expensive.

SUMMARY OF THE INVENTION

It is, therefore, an object of the present invention to create a hearing aid containing specific circuitry for performing a running adaptive matching between the inputs of microphones and electronics for both the low frequency phase/time response and also the sensitivity, so that there will be no need for precise selection of matching microphones and electronics. It will rather be sufficient to use randomly chosen microphones and components of their respective types as long as they are within their production tolerances.

This will also reduce service costs considerably, because microphones and components could be changed one piece at a time. Also, the effects of aging and changes due to environmental stress may then be compensated for by the present invention. Particularly, the new adaptive matching uses no additional signals but uses the acoustical signals being present at the microphones at any time.

These and other objects of the invention will be achieved by a hearing aid of the type referred to above by using an adaptive phase matching circuit inserted into said at least two microphone channels, the adaptive phase matching circuit having its outputs connected to an acoustical delay compensation means followed by a parameter control circuit, the output of which is applied to a controllable filter means inserted into at least one of said at least two microphone channels inside said adaptive phase matching circuit. It is of special advantage if filter means are provided in front of said acoustical delay compensation means.

The invention will now be described in detail in conjunction with the acompanying drawings.

SHORT DESCRIPTION OF THE DRAWINGS

In the drawings

DETAILED DESCRIPTION OF THE INVENTION

While all operations of the circuitry to be described for the various embodiments of the invention are performed with digital implementations and, normally, will use highly integrated circuitry, it is to be understood that, in principle, the entire circuitry could also be implemented in analog technique.

However, the digital version is preferably used.

Since all signals emanating from microphones are in analog form, it is to be understood that between the at least two microphones and the digital circuits of the invention to be described here, an analog to digital conversion has to be performed, possibly by using sigma-delta conversion techniques.

Figure 1:
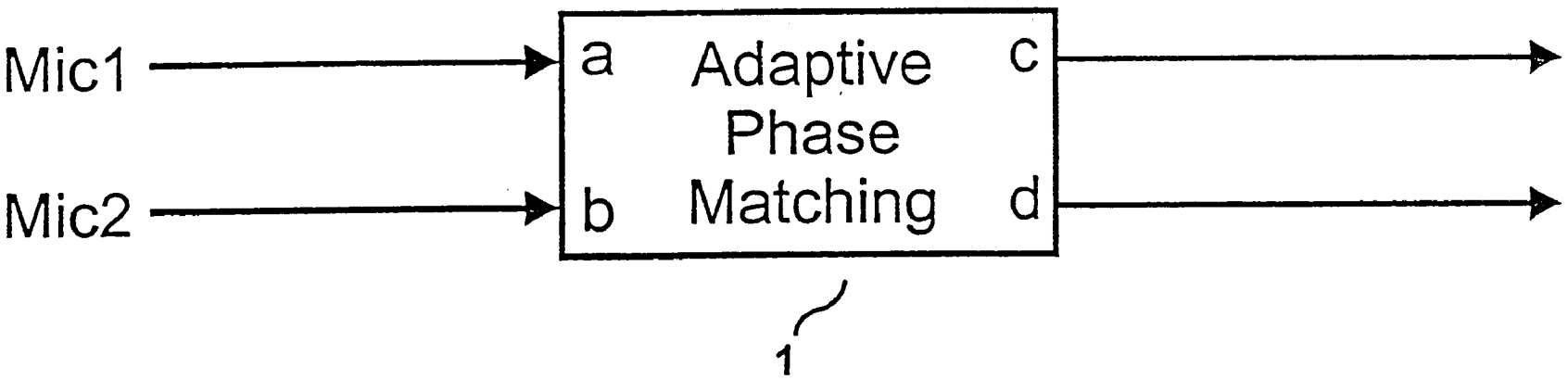
FIG. 1 shows a first implementation of the invention.
Figure 2:
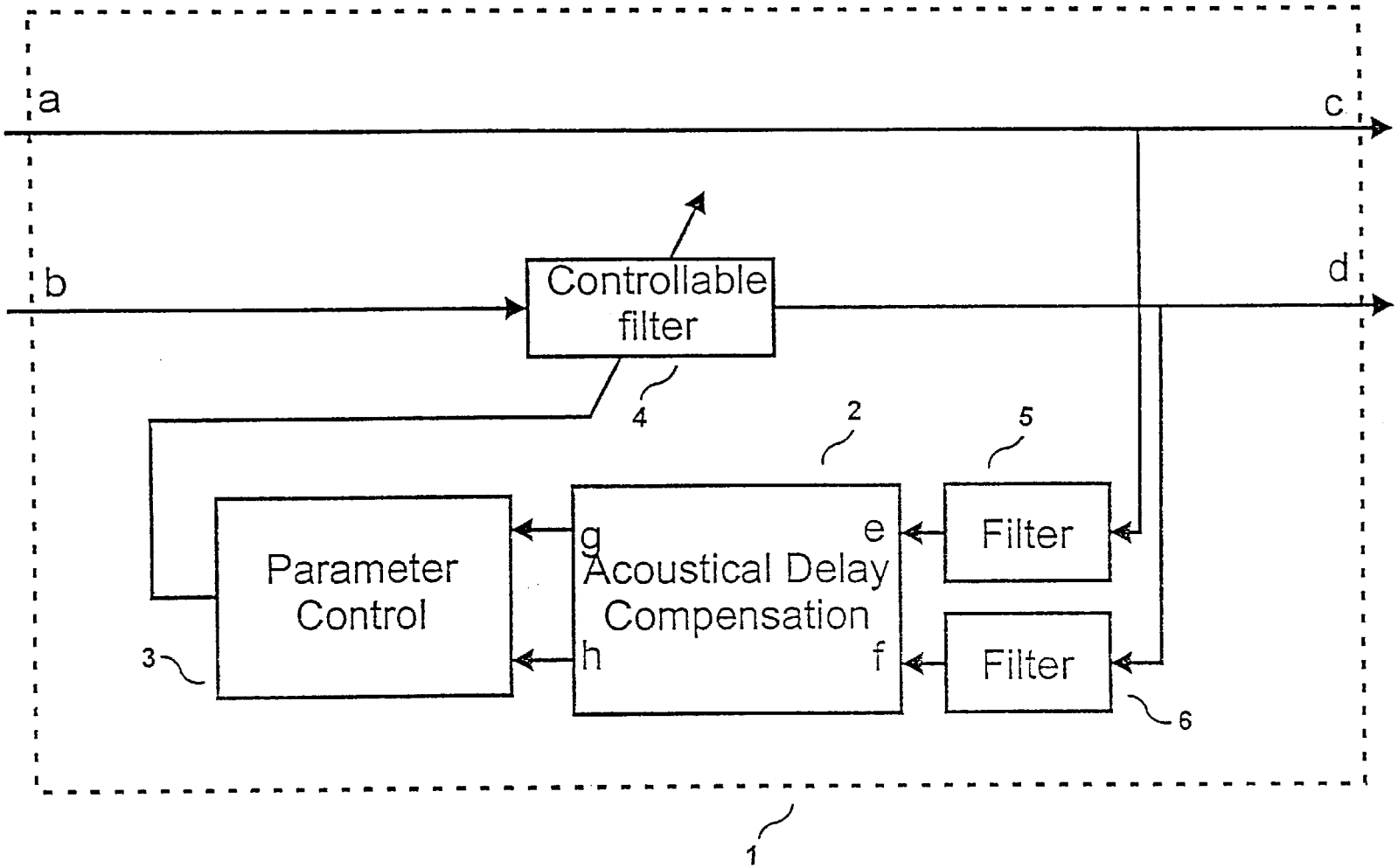
FIG. 2 shows schematically, the circuitry of an adaptive phase matching circuit.

The first embodiment of the invention as shown in FIGS. 1 and 2 comprises an adaptive phase matching circuit 1 with input terminals a, b and output terminals c, d and contains an acoustical delay compensation circuit 2, a parameter control means 3 and a controllable filter means 4.

The adaptive phase compensation circuit is provided for compensation of the said at least two microphones. In a test environment the phase compensation could be based on a test sound generated by a test sound source fixed in space, to be used during an initial or periodical adjustment procedure. However, in practical use, and since the test sound, preferably, should be in the audio frequency range, a test sound source fixed in space is not convenient for a continuous adjustment during normal use. Therefore, in a preferred embodiment of the invention this compensation may instead be based on the sound present in the surrounding space.

If the microphones were receiving exactly the same sound signals, the only difference would be the inherent phase and delay difference (apart from the difference in sensitivity).

This means that an optimal phase matching may only be achieved, if the microphones receive the same signal, i.e. the acoustical signals arrive at exactly the same time at the microphones. The microphones will, of course, be placed with a difference from each other which will in fact result in a time delay between the microphones, depending on the location of the acoustical signal source in space.

The sound from the environment does not necessarily arrive at the microphones at the same time. In fact, the arrival times are normally different for the two or more microphones and, of course, change. Thus, the sound signals will have a certain delay with respect to each other. Therefore, the acoustical delay compensation has to compensate for this delay to create a virtual test sound based upon the sound present in the surrounding space.

For this purpose an acoustical delay compensation circuit is connected at the output side at terminals c, d of the adaptive phase matching circuit 1. This acoustical delay compensation circuit 2 with its input terminals e, f and output terminals g, h tries to compensate for this delay by applying an extra delay in at least one of the two microphone channels for adjusting it, until a minimum difference between the input signals of both microphones is achieved.

For controlling the phase matching a parameter control circuit 3 is connected at the output terminals g, h of the acoustical delay compensation circuit 2.

Such a parameter control circuit, in principle, performs some comparison between output signals, in this case of the acoustical delay compensation circuit 2, and determines in which way control values have to be adjusted for the circuits to be controlled, in this case a controllable filter 4. Usually those adjustment values are integrated to generate the control parameters which can be used for controlling controllable devices, circuits or the like. As has been said, this adaptive phase matching circuit 2 contains at least one controllable filter 4 included in at least one of the said at least two microphone channels inside the adaptive phase matching circuit 1.

However, it is preferred to use additional filter means 5 and 6 which are connected to the output terminals of the adaptive phase matching circuit and are arranged in front of the acoustical delay compensation circuit 2. It may be advantageous to use high pass filters in front of the acoustical delay compensation circuit to remove DC components. This will, in fact, change the amplitude spectrum a little for the lowest frequencies.

On the other hand, the controllable filter 4 could be either an all pass filter or a high pass filter. This filter could perform the phase matching and, at the same time, in case of a high pass filter, could perform the elimination of any DC components as well.

Figure 3:
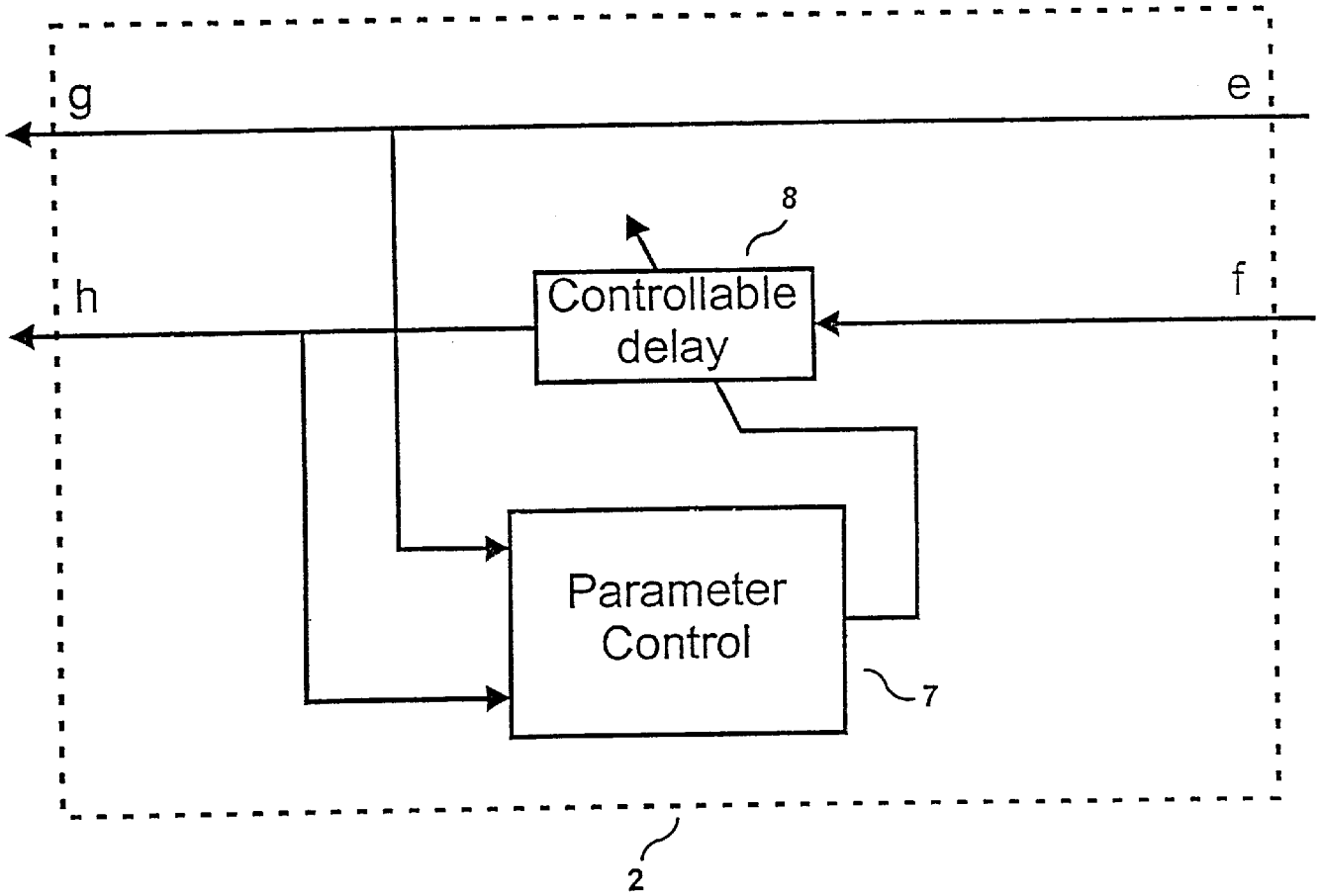
FIG. 3 shows schematically, the circuitry of the acoustical delay compensation circuit as incorporated into the adaptive phase matching circuit.

As can be seen from FIG. 3, the acoustical delay compensation circuit 2 contains another parameter control circuit 7, connected to the output terminals g, h of said circuit and controlling a controllable delay device 8 inserted into at least one of said at least two microphone channels between input terminals e, f and output terminals g, h.

However, it is certainly of advantage to use an adaptive sensitivity matching circuit 9 in front of the adaptive phase matching circuit 1 as described in connection with FIGS. 1 to 3. By letting the sensitivity matching depend on the signals after the phase matching, as in FIG. 5, amplitude errors introduced by filters before the phase matching, or by the phase matching itself may be compensated. This compensation may be performed at desired frequencies or frequency ranges. However, a compensation may be performed, e.g. at low frequencies only, which will move the error to higher frequencies, where problems due to poor matching are less severe.

Figure 4:
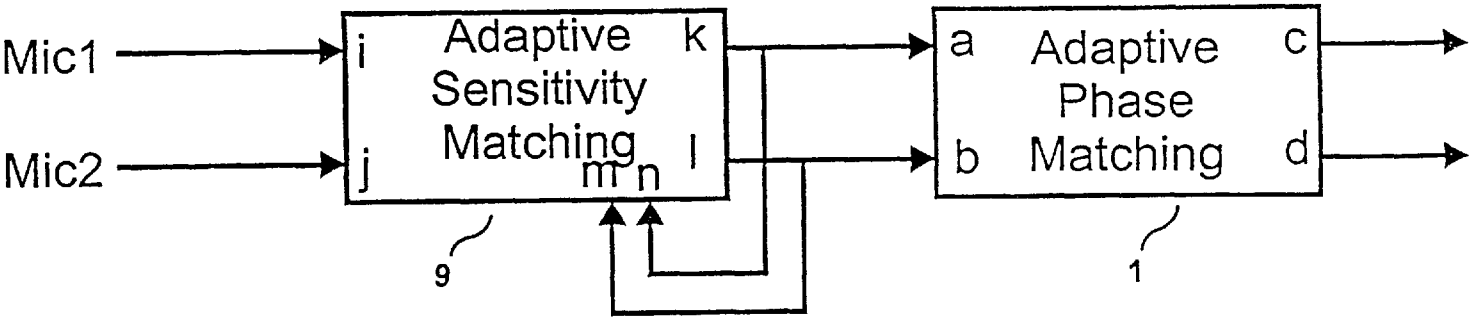
FIG. 4 and FIG. 5 show schematically, further implementations of invention, additionally employing a sensitivity matching circuit
Figure 5:
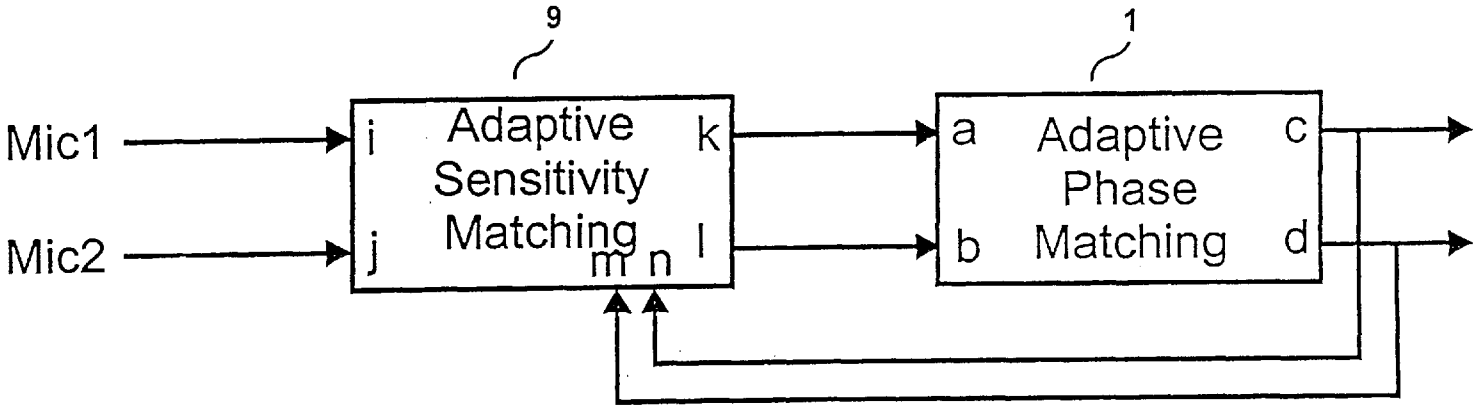
Figure 6:
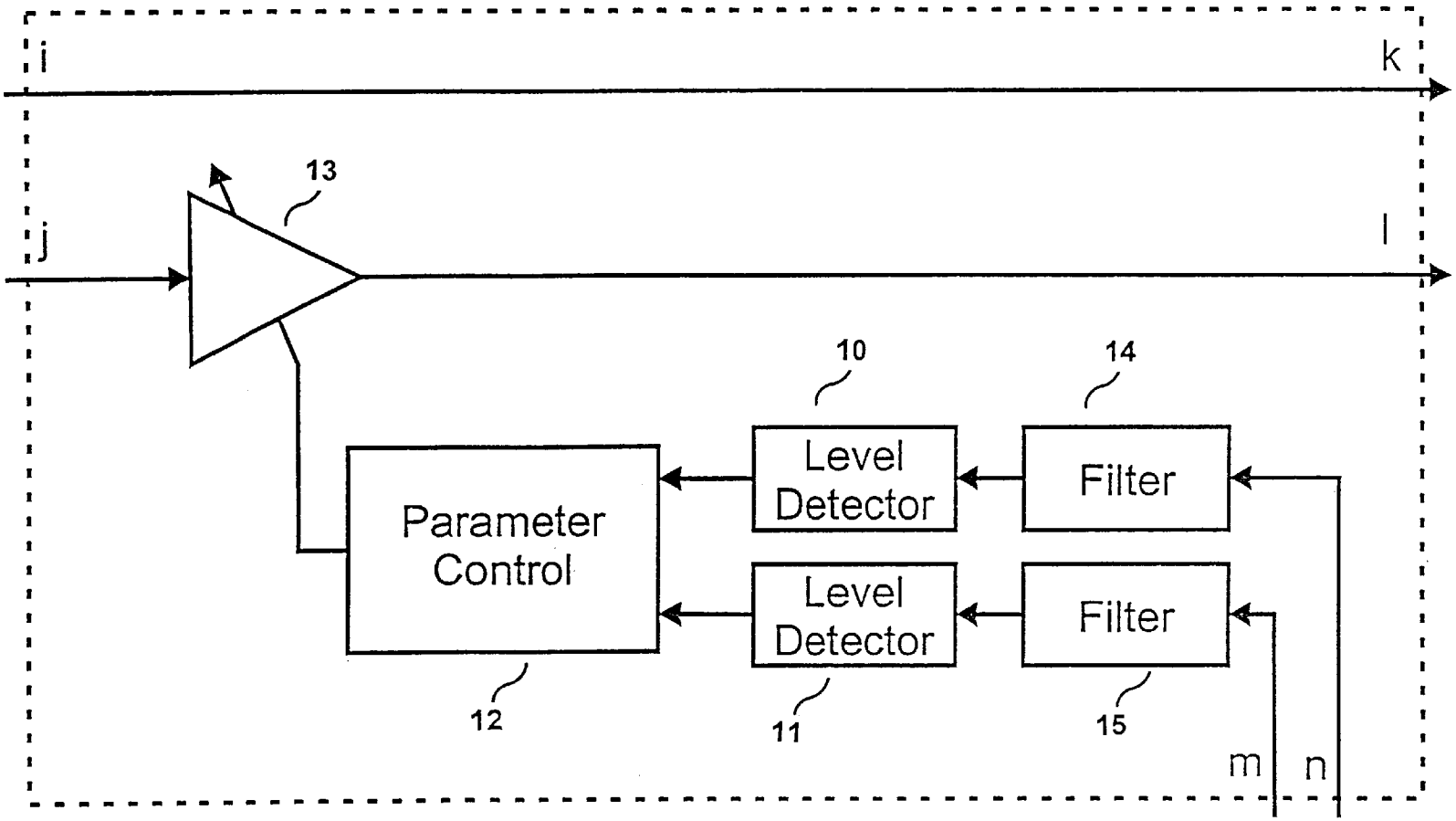
FIG. 6 shows schematically, the circuitry of the adaptive sensitivity matching circuit.

As shown in FIGS. 4 and 5 there are two possible ways to combine the adaptive sensitivity matching circuit with the adaptive phase matching circuit. As will now be described in more detail the adaptive sensitivity matching circuit 9 as shown in FIG. 6, with input terminals i, j, output terminals k, l, and control terminals m, n comprises basically two level detectors 10 and 11 connected to control terminals m, n and hence to the output terminals k, l to determine the signal levels in the at least two microphone channels, followed by a parameter control circuit 12 which performs some comparison of the two signal levels and determines in which way the gain of a controllable gain amplifier 13 should be adjusted to make the two signal levels as equal as possible.

One other way of combining the two adaptive matching circuit is specifically shown in FIG. 5, in which the outputs of the adaptive phase matching circuit 1 are applied to the control terminals m, n of the adaptive sensitivity matching circuit to introduce additionally the adaptively matched phase relationship into the adaptive sensitivity matching circuit as well.

Also in the case of the adaptive sensitivity matching circuit 9 it may be of advantage to arrange filter means 14, 15 in front of the level detector means 10, 11. These filters could then be used to eliminate any possible DC components as well. It may therefore be desirable to select the filters 14, 15 to focus on specific frequencies (typically the low frequencies). Any other selection for different frequency bands is equally possible.

With this novel circuitry in accordance with the present invention, adaptive phase and sensitivity matching could be achieved without the need to use any additional signals, by using the acoustical signals being present at the microphones at any time.

The objects of the invention, as recited in the opening pages, could all be achieved by the circuitry disclosed.

What is claimed is:

1. Hearing aid with a controllable directional characteristic, having at least two spaced apart microphones (Mic1, Mic2) in at least two microphone channels, at least one signal processing unit, at least one output transducer and a directional controlling system, with means of adaptively matching the characteristics of at least two microphones, characterized by an adaptive phase matching circuit (1) with input terminals (a, b) and output terminals (c, d) and inserted into said at least two microphone channels, the adaptive phase matching circuit (1) having its outputs (c, d) connected to an acoustical delay compensation means (2), followed by a parameter control circuit (3) the output of which is applied to a controllable filter means (4) inserted into at least one of said at least two microphone channels inside said adaptive phase matching circuit.

2. Hearing aid in accordance with claim 1, characterized in that filter means (5, 6) are provided in front of said acoustical delay compensation means (2).

3. Hearing aid in accordance with claim 1, characterized in that said acoustical delay compensation means (2) with input terminals (e, f) and output terminals (g, h) comprises a parameter control circuit (7) for controlling controllable delay means (8) inserted in at least one of said at least two microphone channels between respective input and output terminals of said acoustical delay compensation means.

4. Hearing aid in accordance with claim 1, characterized by the addition of an adaptive sensitivity matching circuit (9) in front of said adaptive phase matching circuit (1), being coupled to said at least two microphones (Mic1, Mic2) and the respective microphone channels, having input terminals (i, j), output terminals (k, l) and control terminals (m, n), said adaptive sensitivity matching circuit comprising for each microphone channel, and connected to said control terminals (m, n), level detector means (10, 11) followed by a parameter control (12) for controlling a controllable gain amplifier (13) arranged in at least one of the said two microphone channels, to remove any difference in sensitivity of the said at least two microphones.

5. Hearing aid in accordance with claim 4, characterized by filter means (14, 15), arranged in front of said level detector means (10, 11).

6. Hearing aid in accordance with claim 1, characterized in that the output of said adaptive phase matching circuit (1) is applied to said control terminals (m, n) of said adaptive sensitivity circuit (9).

7. Method of operation of a hearing aid with a controllable directional characteristic having at least two spaced apart microphones in at least two microphone channels, at least on signal processing unit, at least one output transducer and a directional control system as well as means for adaptively matching the phase of said at least two microphones, by applying the output signals of said adaptive phase matching circuit to an acoustical delay compensation means for determining a parameter control value for controlling controllable filter means inserted into at least one of said at least two microphone channels inside of said same adaptive phase matching circuit.

8. Method in accordance with claim 7, characterized by filtering said output signals of said adaptive phase matching circuit before applying the filtered output signal to said acoustical delay compensation means.

9. Method in accordance with claim 7, characterized by feeding back the output of said acoustical delay compensation means for determining updated parameter values and using same to control controllable delay means inserted inside the acoustical delay compensation means in at least one of said at least two microphone channels between the respective input and output terminals.

10. Method in accordance with claim 7 for matching the characteristics of the said at least two microphones of said at least two microphone channels with respect to their sensitivity and/or their phase relationship by applying the output signals of said at least two microphones to an adaptive sensitivity matching circuit followed by an adaptive phase matching circuit and feeding back the output signals of said adaptive sensitivity matching circuit to a control input of the said same adaptive sensitivity matching circuit.

11. Method in accordance with claim 7, characterized by filtering the output signal of said adaptive sensitivity matching circuit before applying it to said control terminals of said same adaptive sensitivity matching circuit.

12. Method in accordance with claim 10, characterized by filtering the said output signal of said adaptive sensitivity matching circuit for each microphone channel, applying the corresponding output signals each to a level detector and compare the two resulting levels, using the result of said comparison for adjusting and updating the gain in at least one of the said two microphone channels to achieve identity of the two signal levels.

13. Method in accordance with claim 10, characterized by feeding back the output signal of said adaptive phase matching circuit to said control terminals of said adaptive sensitivity matching circuit.

14. Method in accordance with claim 12, characterized by filtering the output signal of said adaptive phase matching circuit before applying it to the control terminals of said adaptive sensitivity matching circuit.

* * * * *